United States Patent [19]

Ahlgren

[11] 3,979,787

[45] Sept. 14, 1976

[54] METHOD OF SUPPORTING BRIDGE STRUCTURES AND LIKE HEAVY-WEIGHT RIGID STRUCTURES UPON DISPLACEMENT THEREOF

[76] Inventor: Nils Harald Ahlgren, Skyttevagen 22 F, 133 00 Saltsjobaden, Sweden

[22] Filed: Jan. 2, 1975

[21] Appl. No.: 537,937

Related U.S. Application Data

[63] Continuation of Ser. No. 295,152, Oct. 5, 1972, abandoned.

[30] Foreign Application Priority Data

Oct. 8, 1971 Switzerland ..... 12744/71

[52] U.S. Cl. ..... 14/75; 61/45 D; 14/16.1

[51] Int. Cl.[2] ..... E01D 19/02

[58] Field of Search ..... 14/16, 27, 75; 61/45 D, 61/46.5

[56] References Cited

UNITED STATES PATENTS

| | | | |
|---|---|---|---|
| 809,071 | 1/1906 | Motley | 14/16 |
| 1,827,921 | 10/1931 | White | 61/51 |
| 2,907,172 | 10/1959 | Crake | 61/46.5 |
| 2,960,833 | 11/1960 | Hayward | 61/46.5 |
| 3,097,829 | 7/1963 | Seddon | 61/45 D |
| 3,564,857 | 2/1971 | Von Hippel | 61/45 D |
| 3,689,953 | 9/1972 | Markakis | 14/27 |

*Primary Examiner*—Nile C. Byers, Jr.
*Attorney, Agent, or Firm*—Rose & Edell

[57] ABSTRACT

For supporting bridge structures and like heavy-weight rigid structures upon displacement thereof, at more points than those giving statically determined bearing forces, the rigid structure is placed on a plurality of hydraulic jacks distributed beneath it and provided with sliding means at their upper ends facing the structure. The jacks are so coupled hydraulically in groups that the bearing force is uniformly distributed in each group independently of whether there are variations in height between those surfaces of the rigid structure which are in contact with the sliding means at the upper ends of the jacks.

Upon displacement of bridge structures and like heavy-weight rigid structures supported on a plurality of sliding means distributed in groups beneath it each of the sliding means in at least one group is associated with a jack for displacement of the structure, the jacks at the sliding means in said group cooperating hydraulically at the displacement.

4 Claims, 4 Drawing Figures

Figure 1:
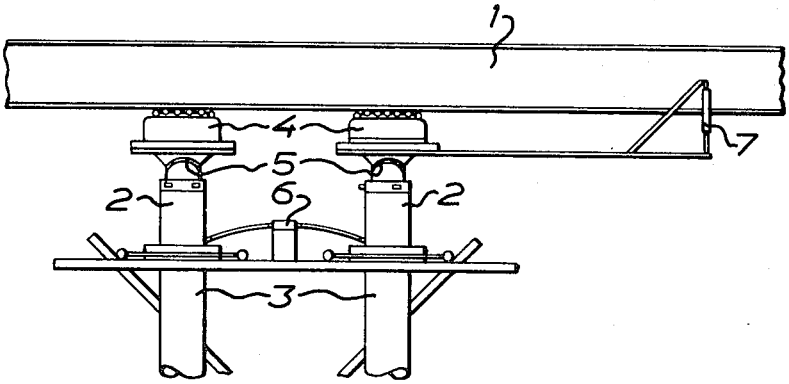

METHOD OF SUPPORTING BRIDGE STRUCTURES AND LIKE HEAVY-WEIGHT RIGID STRUCTURES UPON DISPLACEMENT THEREOF

This is a continuation of application Ser. No. 295,152, filed Oct. 5, 1972 now abandoned.

The present invention relates to a method of supporting bridge structures and similar heavy-weight rigid structures, upon displacement thereof, at more points than those giving statically determined bearing forces.

The great bearing pressures that arise upon displacement of heavy structures must be distributed on several points. At present such a distribution is realised by means of cradle supports. These supports provide longitudinal, but not transversal equalisation of load, which is disadvantageous as far as juxtaposed cradles are concerned because they have had to support differently large parts of the load int.al. owing to dimensional discrepancies.

The above disadvantages are overcome by the method according to the invention, in which the rigid structure is placed on a plurality of hydraulic jacks which are distributed beneath it and have sliding means at their upper ends facing the structure, and the jacks are so coupled hydraulically in groups that the bearing force is uniformly distributed in each group independently of whether there are variations in height between these surfaces of the rigid structure which are in contact with the sliding means at the upper ends of the jacks.

The invention also involves the advantage that unlike the cradle supports the hydraulic jacks may be spaced large distances apart both longitudinally and laterally. Thus, the hydraulic jacks may be placed on existing bridge-pillars and like members whereas cradle supports require specially designed bearings. It is an essential characteristic feature of the invention that the rigid structure is guided laterally during displacement by inclining the displacement plane by adjustment of the hydraulic jacks in at least one of the groups so that the rigid structure will move in the desired direction under its own weight.

The invention also relates to a method of displacing bridge structures and similar heavy-weight rigid structures which are supported on a plurality of sliding means distributed in groups beneath said structures. In this method each of the sliding means in at least one group is associated with a jack for displacement of the structure, and the jacks associated with sliding means in said group hydraulically cooperate at the displacement of the structure. This arrangement provides an equalization between the jacks.

The two methods according to the invention are more fully described hereinbelow with reference to the accompanying drawings which show a bridge structure to be displaced, which is supported on sliding means arranged beneath the structure.

Figure 2:
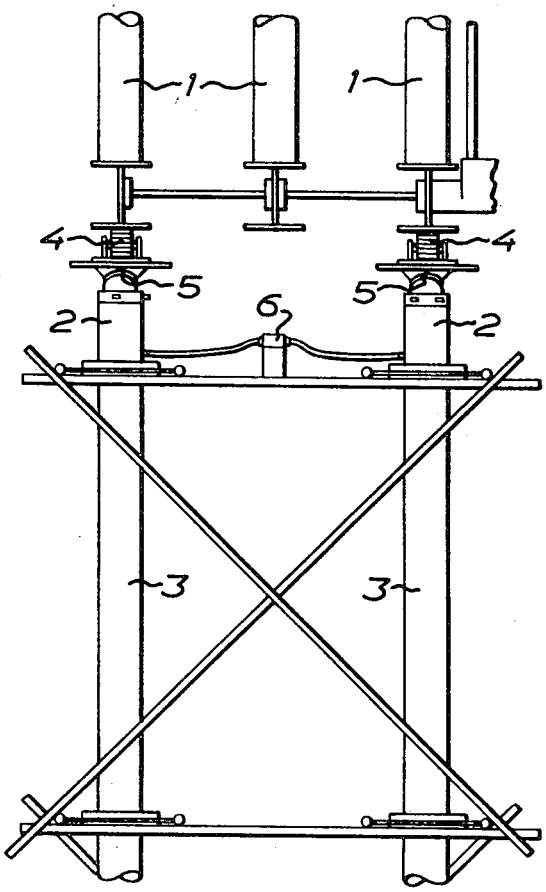
Figure 3:
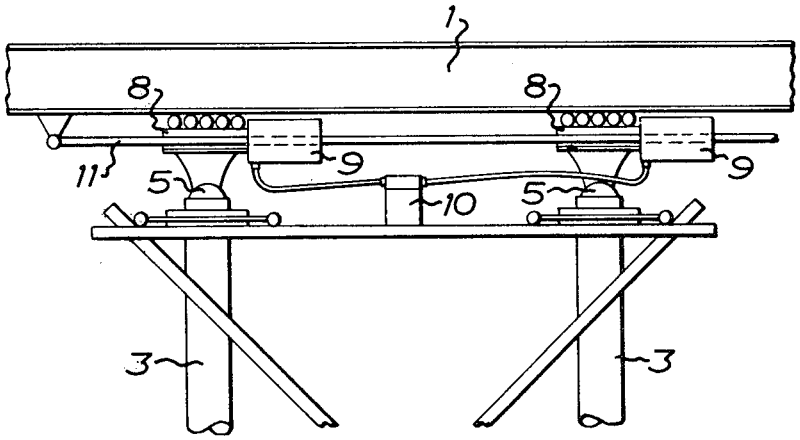
Figure 4:
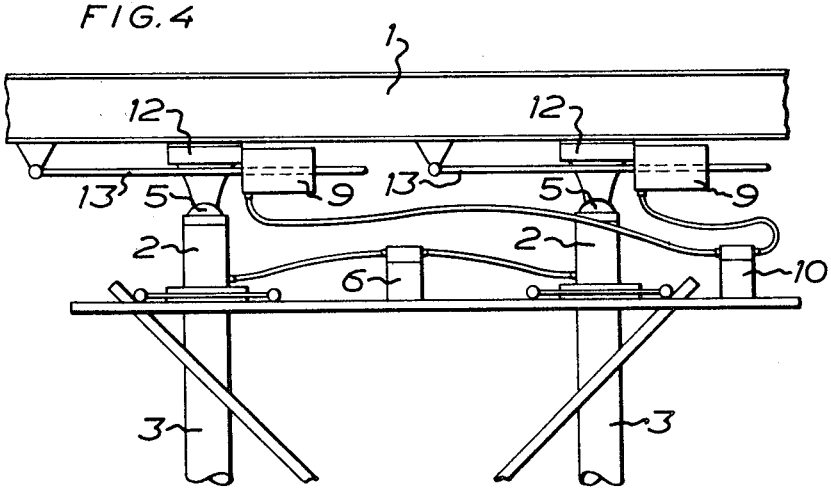

In the drawings:

FIG. 1 is a side view of the bridge structure in cooperation with hydraulic jacks in accordance with the first method, FIG. 2 is a front view of the bridge structure in FIG. 1, FIG. 3 is side view of the bridge structure in cooperation with hydraulic jacks in accordance with the second method, FIG. 4 is a side view of the bridge structure in cooperation with hydraulic jacks in accordance with the two methods.

1 designates the heavy-weight rigid bridge structure which is to be displaced. According to the embodiment shown in FIGS. 1 and 2 the bridge structure 1 is placed on a plurality of hydraulic jacks 2 distributed beneath it on the pillars 3 of the bridge structure 1. At their upper ends facing the bridge structure 1 the jacks 2 have sliding means 4 which in the embodiment illustrated are roller carriages but which might also be rolls, sliding surfaces etc. The roller carriages 4 are connected with the hydraulic jacks 2 in such a way as to permit angular positioning of said carriages in at least two directions, whereby the roller carriages 4 will always adapt themselves to the displacable heavy-weight bridge structure 1. In the embodiment shown said angular positioning is attained with the aid of the spherical joint 5 between the jack 2 and the roller carriage 4.

The hydraulic jacks 2 have been so coupled hydraulically in groups that the bearing force is uniformly distributed in each group independently of whether there are variations in height between those surfaces of the bridge structure 1 which are in contact with the sliding means 4 at the upper ends of the jacks 2. A source of pressure medium common to the group is designated 6.

At least some of the roller carriages 4 are provided with control means 7 which directly or indirectly cooperate with the bridge structure 1 for adjustment of the direction of the roller carriages 4.

In the embodiment shown in FIG. 3 the bridge structure 1 rests on the roller tracks 8 mounted on the pillars 3 of the bridge structure 1. The roller tracks 8 are connected with the pillars 3 so as to permit angular positioning of said tracks in at least two directions. Said angular positioning is attained with the aid of the spherical joints 5.

The roller tracks 8 beneath the bridge structure 1 are distributed in groups. Each of the roller tracks 8 in at least one group is associated with a jack 9 for displacement of the structure 1, and the jacks 9 associated with the roller tracks 8 in said groups hydraulically cooperate at the displacement. Thus, the jacks 9 are connected to a pressure medium source 10 common to the group.

The jacks 9 are preferably coupled with the sliding means formed by the roller tracks 8 such that the thrust of the jacks 9 is transferred directly to the sliding means with which the respective jack is associated.

Each jack 9 might be adapted to engage a special tie means such as a tie bar or like member connected to the bridge structure 1. However, in certain cases such hydraulically cooperating jacks 9 in the group as are arranged after each other in the direction of pull should be caused to engage a tie means 11 common to them (cf. FIG. 3).

In the embodiment shown in FIG. 4 the bridge structure is placed on a plurality of hydraulic jacks 2 distributed beneath it on the pillars 3 of the bridge structure 1. At their upper ends facing the bridge structure 1 the jacks 2 are provided with sliding surfaces 12 which may either be formed by a self-lubricating material, such as Teflon, or be provided with a lubricant, such as graphite or oil. The sliding surfaces 12 cooperate directly or indirectly with the underside of the structure 1.

As in the embodiment according to FIGS. 1 and 2 spherical joints 5 are arranged between the jacks 2 and the sliding means 12 cooperating with the bridge structure. Further, the hydraulic jacks 2 are so coupled in groups that the bearing force is uniformly distributed in each group. To this end, the group is provided with a pressure medium source 6 common to all jacks of the group. As in the embodiment according to FIG. 3 the sliding means 12 beneath the bridge structure 1 are distributed in groups, each of the sliding means 12 in at least one group being associated with a jack 9 for displacement of the structure 1. The jacks 9 at the sliding means 12 in the group cooperate hydraulically at the displacement inasmuch as they are connected to the pressure medium source 10 common to the group. Each jack 9 cooperates with a tie means 13.

In a modified embodiment of the invention the pressure medium source 6 and 10 of FIG. 4 might be a single pressure medium source, whereby simultaneous lifting and displacement of the bridge structure 1 is attained. The sliding means 12 distributed in groups beneath the structure 1 are thus suported by the hydraulic jacks 2 which cooperate hydraulically in the group simultaneously as they cooperate hydraulically with the jacks 9 at the sliding means 12 in said group.

The invention is not restricted to that described with reference to the drawings, as modifications can be resorted to within the scope of the appended claims.

What I claim and desire to secure by Letters Patent is:

1. An apparatus for supporting a heavy structure during substantially horizontal displacement thereof, at more locations than those required to give statically determined bearing forces therefor, said apparatus including:

at least one group of support means disposed beneath said structure, where each said group of support means comprises:

a plurality of means, one at the upper end of each of said support means, for allowing said structure to slide substantially horizontally relative to said support means; each of said means at the upper ends of said support means being adjustably connected thereto in such a manner that angular positioning of said means at the upper ends of said support means is permitted about at least two axes;

equalization means connecting each of said plurality of support means in said group to each other support means in said group and to a source of pressure;

means operatively connected to said source of pressure for adjusting the support forces applied to said structure by each of said plurality of support means so that the bearing force of the weight of said structure is uniformly distributed in said group of support means independently of any variations in height between the surfaces of said structure which are in contact with said means at the upper ends of said support means;

actuating means operatively connected to at least one of said means at the upper ends of said support means and to said structure for causing angular adjustment of said means at the upper ends of said support means at least about a substantially vertical axis.

2. The apparatus of claim 1 where said means at the upper ends of said support means comprises roller carriages, rolls or sliding surfaces.

3. The apparatus of claim 1 where said plurality of support means comprises a plurality of hydraulic jacks which are hydraulically coupled in groups.

4. The apparatus of claim 1 further comprising a plurality of pulling jack means co-operating with pulling tie means secured to said structure, where said pulling jack means are secured to at least several of said plurality of support means.

* * * * *